United States Patent [19]

Sasayama

[11] Patent Number: 4,589,916

[45] Date of Patent: May 20, 1986

[54] ULTRA CLEAN STAINLESS STEEL FOR EXTREMELY FINE WIRE

[75] Inventor: Shinichi Sasayama, Gunma, Japan

[73] Assignee: Daido Tokushuko Kabushiki Kaisha, Nagoya, Japan

[21] Appl. No.: 704,242

[22] Filed: Feb. 22, 1985

[30] Foreign Application Priority Data

Feb. 23, 1984 [JP] Japan ..... 59-33242

[51] Int. Cl.[4] ..... C22C 38/16

[52] U.S. Cl. ..... 75/126 R; 75/10 R; 75/49; 75/130.5

[58] Field of Search ..... 75/10 R, 130.5, 49, 75/126

[56] References Cited

U.S. PATENT DOCUMENTS

| | | | |
|---|---|---|---|
| 3,046,107 | 7/1962 | Nelson | 75/60 |
| 3,067,473 | 12/1962 | Hopkins | 75/10 R |
| 3,235,373 | 2/1966 | Poole | 75/10 R |
| 3,519,059 | 7/1970 | Voskobornikov | 75/10 R |
| 3,885,958 | 5/1975 | Grunbaum | 75/130.5 |

*Primary Examiner*—Peter D. Rosenberg

*Attorney, Agent, or Firm*—Armstrong, Nikaido, Marmelstein & Kubovcik

[57] ABSTRACT

An ultra clean stainless steel which allows wire drawing of extremely fine wire with a diameter of 30 micron or less is disclosed. This steel contains 0.006% or less of Al, 10 ppm or less of O, with an inclusion particle size of less than 10 micron.

This type of ultra clean stainless steel is produced by refining steel using vacuum induction furnace melting or the AOD method, and preferably carrying out electroslag refining followed by vacuum arc furnace remelting.

1 Claim, 1 Drawing Figure

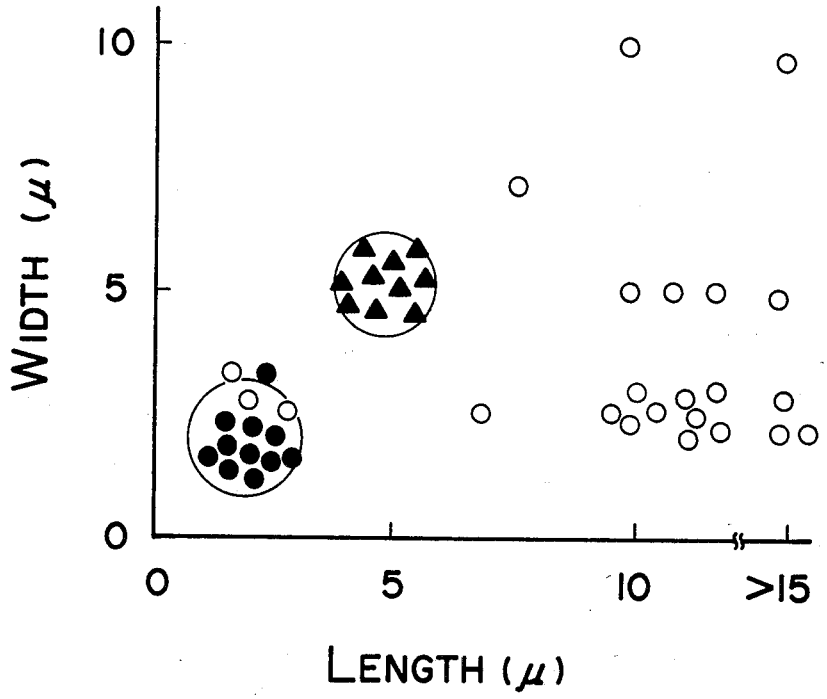
● VIM-ESR-VAR ($Al_2O_3$ FREE)
▲ AOD-ESR-VAR ( 〃 )
○ AOD-ESR-VAR

ULTRA CLEAN STAINLESS STEEL FOR EXTREMELY FINE WIRE

BACKGROUND OF THE INVENTION

1. Field of the Invention

The present invention relates to an ultra clean stainless steel for use in the manufacture of extremely fine wire, and its production, with inclusions in the steel being reduced to the highest degree.

The ultra clean stainless steel of the present invention is ideal for stainless steel wire used in such products as fine wire mesh, precision filters, or printing mesh for IC printed circuits or glass products.

The stainless steels to which the present invention can be applied are Cr-based and Ni-Cr-based stainless steels. These stainless steels may further contain suitable special elements for the purpose of improving their properties.

2. State of the Art

For the uses mentioned above, a stainless steel extremely fine wire with a diameter of 30 micron or less is required. At present, the finest wire that can be manufactured from industrially produced stainless steel has a diameter of 40 micron, and the above requirement can not be met. Using existing materials, breakage occurs easily at the time of wire drawing and drawing yield is noticeably decreased.

In the manufacture of extremely fine steel wire, the cleanest possible material must be prepared. The material for the above-mentioned 40 micron extremely fine wire is produced by AOD (argon oxygen decarburization) slag refining followed by electroslag remelting (hereafter referred to as ESR) which is considered, until now, to be one of the cleanest steels available.

SUMMARY OF THE INVENTION

An object of the present invention is to provide an ultra clean stainless steel which makes possible a stable, continuous drawing, with no breakage, of extremely fine wire with a diameter of less than 40 micron and, in particular, 30 micron or less.

Another object of the present invention is to provide an industrially profitable method of manufacturing the above-mentioned ultra clean stainless steel for extremely fine wire.

The ultra clean stainless steel for extremely fine wire of the present invention, which achieves the above-mentioned object, is characterized by 0.006% or less, by weight, of Al, 10 ppm or less of O, and an inclusion particle size of less than 10 micron.

The method of manufacturing such an ultra clean steel for extremely fine wire involves refining a deoxygenated steel containing no Al, through vacuum induction melting (hereafter referred to as VIM) or the AOD method, using a slag containing no $Al_2O_3$, followed by vacuum arc furnace remelting (hereafter referred to as VAR). While the VIM or AOD refining methods and the VAR treatment are taking place, it is preferable to carry out ESR refining using a slag containing no $Al_2O_3$.

DRAWING

The Drawing is a graph showing length and width distribution of inclusion particles in the ultra clean stainless steel produced by the experiments according to the present invention.

DETAILED EXPLANATION OF PREFERRED EMBODIMENTS

Through research to achieve the above-mentioned objectives, we obtained the following knowledge.

During drawing of the extremely fine stainless steel wire, wire breakage becomes a large factor due to small amounts of plastic deformation of inclusion particles, especially $Al_2O_3$ inclusion particles. There is a clear correlation between wire breakage and inclusion particle size, and if inclusion particle size is $\frac{1}{3}$ or less the diameter of the wire, wire breakage does not occur. Therefore, a material must be found from which can be manufactured an extremely fine stainless steel wire having as a target diameter 30 micron or less and an inclusion particle size of less than 10 micron. As a result of our investigation it was learned that in order to reduce the $Al_2O_3$ inclusion particles causing small amounts of plastic deformation, total Al content should be reduced to 0.006% or less, by weight. It was also learned that 0.005% or less, by weight, of Al in the form of soluble Al is desirable.

In order to decrease the amount of $Al_2O_3$, it is important to first lower the amount of Al. Accordingly, in addition to using a base material to which Al has not been added, every effort should be made to prevent the addition of Al during subsequent refining.

Because the amount of Cr in stainless steel is high, even if the amount of Al is lowered, $Cr_2O_3$ inclusion particles form easily, causing small amounts of plastic deformation. It was learned that the formation of $Cr_2O_3$ inclusion particles can be controlled, combined with the above-mentioned decrease in the amount of Al, if the amount of O is at the very low level of 10 ppm or less.

In order to decrease Al content of the steel it is preferable to carry out deoxidation without using Al at the step of VIM. Also, at the step of AOD, if the slag for refining contains $Al_2O_3$, Al formed through reduction undergoes reoxidation in the steel, forming $Al_2O_3$, and therefore, a slag which is free of $Al_2O_3$ should be used.

$Al_2O_3$-free slag must also be used when the secondary ESR step of the preferred embodiment is carried out. As an $Al_2O_3$-free slag it is preferable to use a 70–90:30–10 by weight ratio of $CaF_2$:CaO, and, typically, a 80:20 by weight ratio.

In this step, along with a remarkable decrease in the total amount of inclusion particles, it is possible to effectively eliminate very fine $Al_2O_3$ clusters that are difficult to float up and separate.

Spherical inclusion particles are, as a whole, reduced in the final VAR step, resulting in an ultra clean steel.

The following Table shows representative results of the gradual reduction of impurities or inclusion articles in the steel as the steps are carried out.

| | Al (ppm) | O (ppm) | S (ppm) |
|---|---|---|---|
| VIM | 15 | 100 | 160 |
| ESR | 10 | 20-10 | 20-10 |
| VAR | 5-7 | 6 | 20-10 |

According to the present invention, as shown in the following examples, because the diameter of the $Al_2O_3$ inclusion particles is 10 micron or less, and in a preferable operation become as small as 2.5 micron, it is possible to manufacture the above-mentioned stainless extremely fine wire with a diameter of 30 micron, and even a wire with a diameter of 18 micron.

EXAMPLE 1

Stainless steel was refined according to the following process, resulting in a ultra clean steel.

(1) VIM—ESR—VAR (VIM: using $Al_2O_3$-free slag.

ESR: using $CaF_2/CaO=80/20$, and $Al_2O_3$-free slag)

(2) AOD—ESR—VAR (AOD: using $CaO—SiO_2$ based, $Al_2O_3$-free slag.

ESR: using $CaF_2/CaO=80/20$, $Al_2O_3$-free slag.)

(3) AOD—ESR—VAR (AOD: using $CaO—SiO_2$ based, $Al_2O_3$-containing slag.

ESR: using $CaF_2/CaO=80/20$, $Al_2O_3$-free slag.)

The Drawing shows size distribution of inclusion particles in the ultra clean steel obtained in the Example.

(1) The diameter of almost all the inclusion particles was 3 micron or less and almost all were nearly spherical in shape;

(2) inclusion particles with a diameter of close to 5 micron were also almost all nearly spherical in shape, but;

(3) in addition to spherically-shaped inclusion particles, those with an irregular form having a length of approximately 10 micron and a width of 5–10 micron were also present.

EXAMPLE 2

Using JIS SUS304 stainless steel obtained by AOD or VIM, an ultra clean stainless steel was produced by carrying out ESR or VAR, or ESR followed by VAR. The Table shows that amounts of Al and O in this stainless steel, inclusion particle size (maximum cross sectional diameter), and results of wire drawing.

As shown in the Table, steels 1–5 according to the present invention, with total Al contents of 0.006% or less, by weight, and O contents of 10 ppm or less, have inclusion particle sizes of less than 10 micron, and wire drawing to a wire diameter of 30 micron is possible with no problems. In comparison, steels 6–10 contain large inclusion particles, $Cr_2O_3$ inclusion particles are noticeable, and the results of wire drawing are not favorable.

| No. | Refining Step | Al (%) | O (ppm) | Inclusion Particle Size (micron) |
|---|---|---|---|---|
| | Present Invention | | | |
| 1 | AOD - VAR | 0.004 | 7 | 6.5 |
| 2 | AOD - ESR | 0.005 | 7 | 7.0 |
| 3 | AOD - ESR - VAR | 0.003 | 6 | 6 |
| 4 | AOD - ESR - VAR | 0.005 | 7 | 8 |
| 5 | VIM - ESR - VAR | 0.002 | 5 | 6 |
| 6 | VIM - ESR - VAR | 0.006 | 10 | 8 |
| | Comparison | | | |
| 7 | AOD - VAR | 0.003 | 20 | 15 |
| 8 | AOD - ESR | 0.020 | 25 | 15 |
| 9 | AOD | 0.003 | 40 | 20 |
| 10 | VIM - VAR | 0.020 | 8 | 17 |
| 11 | AOD - ESR - VAR | 0.015 | 8 | 15 |

| | Results of Wire Drawing (Diameter:micron) | | | | | |
|---|---|---|---|---|---|---|
| No. | 50 | 40 | 35 | 30 | 25 | 20 |
| | Present Invention | | | | | |
| 1 | A | A | A | A | A | A |
| 2 | A | A | A | A | A | A |
| 3 | A | A | A | A | A | A |
| 4 | A | A | A | A | A | B |
| 5 | A | A | A | A | A | A |
| 6 | A | A | A | A | A | B |
| | Comparison | | | | | |
| 7 | A | B | C | — | — | — |
| 8 | A | B | C | — | — | — |
| 9 | B | C | — | — | — | — |
| 10 | B | C | — | — | — | — |
| 11 | A | B | C | — | — | — |

A favorable
B occasional breakage
C frequent breakage

I claim:

1. An ultra clean stainless steel for use in the manufacture of extremely fine stainless steel wire, comprising an Al content of 0.006% or less, by weight, an O content of 10 ppm or less, by weight, and being free of inclusions having a particle size of 10 micron or greater.

* * * * *